US008308447B2

(12) United States Patent
Hartl

(10) Patent No.: US 8,308,447 B2
(45) Date of Patent: Nov. 13, 2012

(54) PISTON COMPRESSOR PRODUCING AN INTERNAL COOLING AIR FLOW IN THE CRANKCASE

(75) Inventor: Michael Hartl, Unterhaching (DE)

(73) Assignee: Knorr-Bremse System fur Schienenfahrzeuge GmbH, Munich (DE)

( * ) Notice: Subject to any disclaimer, the term of this patent is extended or adjusted under 35 U.S.C. 154(b) by 409 days.

(21) Appl. No.: 11/574,529

(22) PCT Filed: Aug. 31, 2005

(86) PCT No.: PCT/EP2005/009367

§ 371 (c)(1),
(2), (4) Date: May 17, 2007

(87) PCT Pub. No.: WO2006/024510

PCT Pub. Date: Mar. 9, 2006

(65) Prior Publication Data

US 2007/0292289 A1 Dec. 20, 2007

(30) Foreign Application Priority Data

Sep. 2, 2004 (DE) ..... 10 2004 042 944

(51) Int. Cl.

| | |
|---|---|
| ***F04B 49/00*** | (2006.01) |
| ***F04B 23/00*** | (2006.01) |
| ***F04B 41/00*** | (2006.01) |
| ***F04B 39/02*** | (2006.01) |
| ***F04B 39/06*** | (2006.01) |

(52) U.S. Cl. ..... 417/309; 417/366; 417/440

(58) Field of Classification Search ..... 417/545, 417/502, 440, 307–308, 255, 366, 309, 415
See application file for complete search history.

(56) References Cited

U.S. PATENT DOCUMENTS

| | | | | |
|---|---|---|---|---|
| 1,109,154 | A * | 9/1914 | Thomas | 417/255 |
| 1,399,151 | A * | 12/1921 | Putnam et al. | 417/254 |
| 1,445,073 | A * | 2/1923 | Domenico et al. | 417/242 |
| 1,891,083 | A * | 12/1932 | Dodge | 417/242 |
| 2,500,567 | A * | 3/1950 | Phillips | 123/41.86 |
| 3,338,509 | A * | 8/1967 | McAninch | 417/242 |
| 3,858,605 | A * | 1/1975 | Bauer et al. | 137/512.15 |
| 4,492,533 | A * | 1/1985 | Tsuge | 417/372 |
| 4,790,726 | A * | 12/1988 | Balkau et al. | 417/254 |
| 5,152,677 | A * | 10/1992 | Bauer et al. | 417/366 |
| 5,899,669 | A | 5/1999 | Van Grimberge | |
| 6,131,406 | A | 10/2000 | Barowsky et al. | |
| 6,227,815 | B1 * | 5/2001 | Chandra et al. | 417/298 |
| 6,231,321 | B1 * | 5/2001 | Fukudome et al. | 417/502 |

(Continued)

FOREIGN PATENT DOCUMENTS

| | | |
|---|---|---|
| DE | 473 347 | 2/1929 |

(Continued)

*Primary Examiner* — Peter J Bertheaud
(74) *Attorney, Agent, or Firm* — Barnes & Thornburg LLP

(57) ABSTRACT

A compressor piston including a piston in a cylinder; a connecting rod connecting the piston to a crankshaft in a crankcase by a roller bearing; and an air inlet line and an air outlet line in a cylinder head. A tube connection between the air inlet line and the crankcase transports cooling air from the inlet line to the crankcase. The tube connection is exterior the cylinder. An inlet valve is connected to the tube connection which opens when the pressure in the crankcase is less than the pressure in the air inlet line; and an outlet valve is connected to the crankcase which opens when the pressure in the crankcase exceeds a predetermined value.

10 Claims, 1 Drawing Sheet

U.S. PATENT DOCUMENTS

| | | | | |
|---|---|---|---|---|
| 6,698,405 | B2 * | 3/2004 | Bigi | 123/560 |
| 6,890,005 | B1 * | 5/2005 | Chisnell | 285/208 |
| 7,011,111 | B2 * | 3/2006 | Spiegl et al. | 137/855 |
| 2003/0101865 | A1 * | 6/2003 | Murata | 92/99 |
| 2003/0101959 | A1 * | 6/2003 | Hare | 123/196 R |
| 2003/0233993 | A1 * | 12/2003 | Radel | 123/196 R |
| 2004/0237522 | A1 * | 12/2004 | Squires | 60/605.3 |
| 2005/0155562 | A1 * | 7/2005 | Taxon et al. | 123/41.86 |

FOREIGN PATENT DOCUMENTS

| | | | |
|---|---|---|---|
| DE | 157 808 | A | 1/1940 |
| DE | 238 645 | A1 | 8/1986 |
| DE | 197 26 943 | A1 | 1/1999 |
| DE | 101 38 070 | A1 | 2/2003 |
| EP | 1 028 254 4 | A | 8/2000 |

* cited by examiner

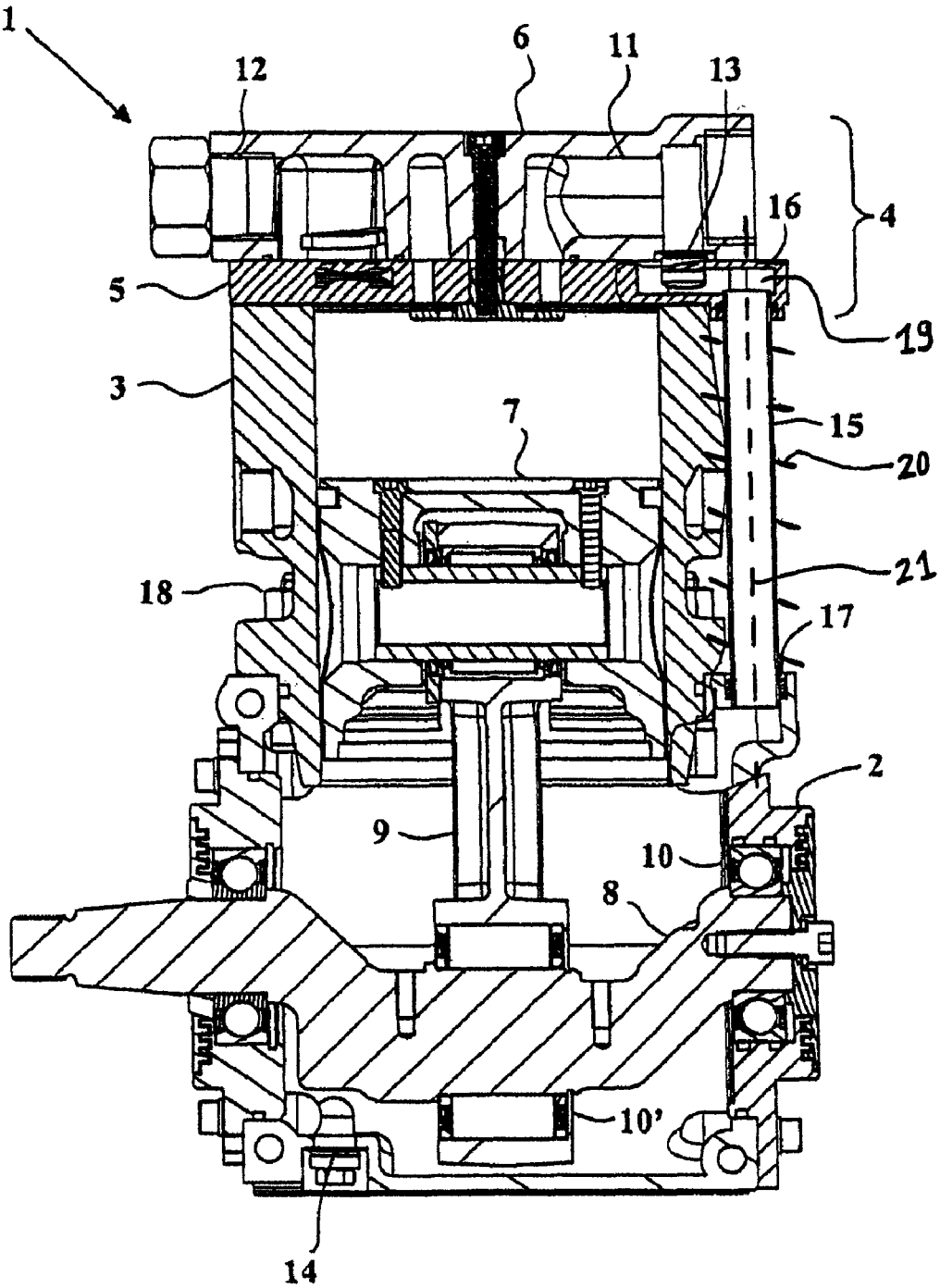
1
12
6
11
13
16
4
5
19
3
7
15
20
21
18
17
2
9
10
8
10'
14

PISTON COMPRESSOR PRODUCING AN INTERNAL COOLING AIR FLOW IN THE CRANKCASE

BACKGROUND AND SUMMARY OF THE DISCLOSURE

The invention relates to a piston compressor, in particular a reciprocating piston compressor for generating compressed air.

A reciprocating piston compressor including at least one piston which is connected to a crankshaft via an associated connecting rod which is mounted by way of a roller bearing. The piston performs a reciprocating movement in an associated cylinder and compresses intake air via a connecting unit which is integrated into the cylinder head. Cooling air passes out of the intake line into the crankcase via an inlet valve on account of a vacuum in the crankcase which is generated by the piston movement and escapes via an outlet valve out of the crankcase on account of the excess pressure in the crankcase which is generated by the piston return movement. Thus, an internal cooling air flow can be generated in the crankcase.

Piston compressors of this type are usually used everywhere where compressed air is required. But the unit which generates compressed air has to be space saving and therefore of small construction and in the process has high power densities, whereby piston compressors of this type are used mainly in commercial vehicles or rail vehicles. In the case of use in a commercial vehicle, the compressed air which is generated by the piston compressor is used increasingly, in addition to the operation of the brake system, also for the operation of the air suspension system. On account of the associated great requirement for compressed air at high system pressures, multiple stage piston compressors are usually suitable here. The high pressures which are required for the air suspension within short time intervals can be generated with piston compressors of this type. Here, in particular in the past, oil lubricated piston compressors have been used in commercial vehicles. Oilfree compressor concepts have not been able to establish themselves, since the required component service life could not be achieved on account of the high component temperatures which result from the high power density in a very small installation space.

Piston compressors may permit oilfree operation if they are provided with a cooling air throughput. The oilfree operating type has been developed, in particular, for reasons of maintenance and environmental concerns. Here, the prior art shows various concepts, active cooling components, such as fan means, being used for heat dissipation.

DD 238 645 A1 discloses a solution in which the air, moved by a fan wheel, flows through both the compressor unit and the drive motor. In addition to the development of noise, a disadvantage of this variant is the external air include contaminants and is guided through the crankcase. As a result, the contaminants can be deposited on and, on account of the pressure changes, water accumulations can likewise form in the crankcase. In order to counteract these problems, an external filter system and possibly a water separation system are required. Thus increases the maintenance complexity and shortens service intervals, however.

DE 101 38 070 C2 shows a piston compressor, in which the periodic pressure fluctuation which is generated in the crankcase by the reciprocal movement of the operating piston can be utilized via a pair of valves, in order to generate a cooling air flow in the crankcase. Here, an inlet valve opens when the piston performs the reciprocating movement in the direction of the cylinder head and increases the volume of the crankcase. As air flows through the inlet valve into the crankcase as a result of the vacuum which is produced. During the downward movement, in contrast, an excess pressure is produced in the crankcase and an outlet valve which is arranged at a spacing from the inlet valve opens. A cooling air throughput can be generated in the crankcase without additional conveying means as a result of this alternating opening and closing of the pair of valves which comprises the inlet valve and the outlet valve.

In order to avoid the inlet of impure surrounding air, the possibility of removing the cooling air from the intake line is utilized. Furthermore this makes air, which has already been cleaned, available also for the cooling air flow of the crankcase. The intake air is freed of contaminants by cleaning means which are arranged upstream. This is essential significance, in particular, in commercial vehicle construction, as the operating surroundings are usually contaminated with dust to a great extent. Furthermore, in apparatuses for the preparation of compressed air which cause pronounced pressure changes in the operating air, the dew point of the water vapor which is contained in the air can be reached. This causes condensation of the water vapor and therefore the formation of water in the system. In order to avoid the formation of water in the system, water separators can be connected individually upstream of the compressor means. If the cooling air is tapped off from the intake line with a water separator which is connected upstream in addition to the filter system, it is additionally ensured that amounts of water which would cause considerable damage, in particular to the bearings, cannot form when the filtered and dried cooling air flows through the crankcase.

The principle of the inner pump for the conveying of cooling air, on the basis of the piston movement, can also be used in multiple stage piston compressors, as are to be gathered from EP 1 028 254 A2. The low pressure stage has a great piston surface area and the high pressure stage has a small piston surface area, by which a periodically changing pressure profile is likewise produced in the crankcase via the crankcase stroke on account of the difference in the piston surface areas.

However, if the cooling air is branched off from the intake line, the cooling air is heated by the position of the branching line in the cylinder head or near the cylinder head. Direct introduction of the cooling air via an inlet valve, which is situated in the cylinder head, and subsequent guiding of the cooling air past the cylinder, in such a way that cooling air at a correspondingly lower temperature is no longer available for cooling the roller bearings in the crankcase. The service life of oilfree piston compressors is restricted considerably by the high operating temperatures. In particular of the roller bearings is associated with shortened maintenance intervals and can cause operating downtimes. The lubricating grease of the roller bearings ages as a result of decomposition processes at high operating temperatures. For most greases, there are temperature limits of 90° C., which can already be reached after a short duration during operation of the compressor. A reliable lubricating action is no longer ensured as a result, which leads to failure of the roller bearing.

It is therefore the object of the compressor design to provide crankcase ventilation for an oilfree piston compressor, which crankcase ventilation conveys clean cooling air into the crankcase in order to cool thermally loaded components in the crankcase, in particular roller bearings, and has a low temperature during entry into the crankcase.

The present compressor has the branching line of the cooling air arranged from the intake line itself or in the cylinder head, and the cooling air can be guided past the cylinder via at least one tube connection between the cylinder head and the crankcase. The tube connection is guided on the outside past the cylinder, in order to avoid heating of the cooling air.

This solution affords the advantage that the cooling air is not exposed to the heat which is produced in the region of the connecting unit, but is branched off from the intake line at a spacing from this heat source and is guided directly into the crankcase. The solution which was previously known of guiding the cooling air first of all via channels along the circumferential surface of the cylinder causes heating of the cooling air before it reaches the crankcase. In the present solution, the cylinder and the cylinder head can also be cooled by a second, separate cooling air flow, with the result that cooling of these components does not have to be dispensed with. Heating of the cooling air which takes place before entry into the crankcase can therefore be avoided simply. The tube connection is arranged on the outside of the housing and guides the cooling air past the components having the highest temperatures such as the cylinder and the cylinder head. As a result of the arrangement of the tube connection in the open, the temperature of the cooling air can additionally be reduced further via heat dissipation which is based on convection via the tube surface, before said cooling air enters the crankcase.

A further measure of the present piston compressor is that the cooling air which is guided via the at least one tube connection is introduced into the crankcase at a location in the vicinity of which the thermally loaded components such as the roller bearings are arranged in the crankcase. Also the entry location allows the cooling air to flow diagonally through the crankcase, in order to achieve a maximum cooling effect. As a result of the variable design of the tube connection, it is possible for the entry location of the cooling air into the crankcase to be selected in such a way that the components which are to be cooled are situated directly in the cooling air flow. This advantage can be used precisely for the roller bearings which are arranged in a stationary manner in the crankcase, such as the crankshaft mounting in the crankcase, by the cooling air flowing directly onto the roller bearings and cooling the latter.

According to one possible development of the piston compressor, it is proposed that the connection for the cooling air between the cylinder head and the crankcase comprises at least two individually arranged tube connections which are connected in parallel to one another, in order to increase the available tube surface area for cooling. In addition to the increased surface area for convection cooling, the advantage of the arrangement of at least two tube connections is additionally the possibility of arranging the tube connections symmetrically in such a way that the entry locations of the cooling air supply cooling air directly both to the roller bearing of the crankshaft which is arranged on the engine side and also to the roller bearing of the crankshaft which is arranged at the end in the crankcase. Here, the cooling air is guided out of a cooling air chamber in the cylinder head into the tube connection, the cooling air chamber being filled with cooling air via the inlet valve and distributing said cooling air to the tube connections. As a rule, it is sufficient if two tube connections are provided.

In order to provide an operationally reliable and space saving valve arrangement, it is proposed as a further measure that the inlet valve and/or the outlet valve for the cooling air flow are/is configured in the manner of a lamellar valve and the inlet valve is arranged in the cylinder head, in a valve plate or in the crankcase. An advantage of a lamellar valve is the low structural complexity and the high operational reliability. On account of the low space requirement and the flat design of a lamellar valve, the latter can be integrated in an optimum manner into the cooling air chamber of the cylinder head or into the valve plate, to be precise in an adjacent manner with respect to the main inlet valve of the compressor.

In order to minimize heating of the cooling air by way of a further measure, it is proposed that the inlet valve is arranged in the cylinder head spaced from the location of the connecting unit. The heating of the cooling air is minimized and it is guided on the direct path into the crankcase housing by way of an arrangement which is as distal as possible of the inlet valve and therefore of the flow profile of the cooling air after the branching off from the intake line. Branching off of the cooling air outside the cylinder head or the valve plate likewise affords a further solution, but a branching element in the intake line is additionally required here and the inlet valve has to be arranged on the cooling air inlet of the crankcase. However, this solution would be expedient only in the use of one tube connection, as a plurality of inlet valves would be necessary in accordance with the number of tube connections in the event of cooling air guidance via a plurality of tubes.

Another improvement is if a screwing means of the crankcase, the cylinder and the cylinder head comprises at least one tie rod, the tie rod passes through the tube connection. Alternating a screwing means of the crankcase, the cylinder and the cylinder head comprises the tube connection. The number of individual parts can be reduced with both measures, by the tube connection also fulfilling the mechanical function of the screw connection, in addition to guiding the cooling air. If tie rods are guided through the tube connection, a separate screw connection of the crankcase, the cylinder and the cylinder head can be dispensed with and the tube connections are stressed mechanically by way of the tie rods. It being additionally possible for a sealing action to be achieved between the tube connection and the crankcase or the cylinder head by way of the stressing, as the tube connection is loaded compressively as a result of the stressing in the longitudinal direction. In the case of a screw connection of the crankcase, the cylinder and the cylinder head via the tube connection, the latter is stressed mechanically in such a way that both the mechanical tensile forces are absorbed and the function of cooling air guidance can be assumed, and therefore the number of individual parts can be reduced.

In order to achieve a sealing action between the tube connection and the crankcase or the cylinder head, it is proposed that the transition from the tube connection to the crankcase and to the cylinder head has at least one sealing element, in order to avoid leakages. Said sealing element can be manufactured from an O-ring made from plastic or a comparable sealing element, such as a brass sealing ring, as there is therefore higher thermal stability and improved ageing resistance.

One additional measure for further improvement of the cooling of the overall reciprocating piston compressor consists in that the cooling air, before entry into the tube connection, runs via at least one flow channel within the cylinder head and/or the cylinder and brings about cooling. It is possible for the temperature of the cooling air during subsequent flow through the tube connection to be reduced again, in particular by an active cooling unit or on the basis of convection cooling. The tube connection may have cooling bodies on the circumferential surface, in order to increase the dissipation of heat by convection. This principle of intermediate cooling makes it possible for cooling air at a low temperature to enter the crankcase, although that region of the cylinder and the cylinder head which is subjected to pronounced thermal loading has already previously been cooled with the same cooling air. Here, the flow channel (not shown in greater detail) in the cylinder jacket and/or in the cylinder head guides the cooling air past the thermally loaded components and is then guided into the tube connection. In order to reduce the temperature of the cooling air sufficiently again, with the result that said cooling air brings about effective cooling of the roller bearings upon entry into the crankcase, cooling bodies are to be provided on the outside of the tube connection, in order to increase the surface area as a result and to boost the effect of the convection cooling. Cooling by active cooling media can likewise be used, but the latter require an additional structural outlay.

These and other aspects of the present invention will become apparent from the following detailed description of the invention, when considered in conjunction with the accompanying drawing.

BRIEF DESCRIPTION OF THE DRAWING

The FIGURE is a cross section through a reciprocating piston compressor having a laterally arranged tube connection.

DETAILED DESCRIPTION OF THE EMBODIMENT

The reciprocating piston compressor 1 which is shown in the FIGURE comprises a crankcase 2, a cylinder 3 and a cylinder head 4 which is constructed from a valve plate 5 and a connecting unit 6. In the cylinder 3, a piston 7 performs a reciprocating movement which is generated via a crankshaft 8 and a connecting rod 9 which is connected to the crankshaft 8 by roller bearing 10. The air which is situated in the cylinder 3 is drawn into the cylinder 3 as a result of the downward movement of the piston 7 and is compressed during the upward movement of the piston 7. In addition to an intake line 11 and an outlet line 12, the connecting unit 6 has a main inlet valve and a main outlet valve (not shown). The main inlet valve is opened during the downward movement of the piston 7, drawing air into the cylinder 3 from the intake line 11 and closes during the upward movement. In contrast, the main outlet valve is closed during the downward movement of the piston 7, and opens in the upward movement of the piston 7. As a result, the air which is compressed, is guided out of the cylinder 3 via the outlet line 12 and is fed to an external consumer.

The cylinder 3 is connected releasably to the crankcase 2 via a screwing means 18. The crankshaft 8 is mounted rotatably in the crankcase 2 by roller bearings 10, the connecting rod 9 likewise being mounted rotatably on the bent section of the crankshaft 8 via roller bearings 10'.

A periodic pressure change is caused by the reciprocating movement of the piston 7 both in the operating cylinder and in the crankcase 2. An air throughput is caused in the crankcase 2 by the arrangement of an inlet valve 13 and an outlet valve 14, through which air can pass into the crankcase 2 and escape from it. The inlet valve 13 is situated within the cylinder head 4 and removes the cooling air from the intake line 11 which is guided through a tube connection 15 into the crankcase 2, on account of the vacuum in the crankcase 2 as a result of the upward movement of the piston 7. In the exemplary embodiment, the tube connection 15 is arranged between a cooling air chamber 16 in the valve plate 5 and the crankcase 2, by way of at least one air or flow channel 19 in the cylinder head 4 and/or the cylinder 3 to the cooling air chamber 16, which collects cooling air via the inlet valve 13 from the intake line 11. The cooling air therefore flows through the tube connection 15 external the cylinder 3 into the crankcase 2, without being heated at the components at a high temperature, such as the cylinder 3 or the cylinder head 4.

The air in the cooling air chamber 16 may be precooled by well-known devices which cool the cylinder head 4. Also, the surface of the connection tube 15 may include fins or other cooling bodies 20 to increase the surface area of and convection cooling by the connection tube 15.

In order to seal the tube connection 15 and the valve plate 5 or the crankcase 2, sealing elements 17 seal the transitions of the tube connection 15 to the valve plate 5 and the crankcase 2. This prevents an auxiliary air flow and therefore the penetration of contaminants. The tube connection 15 may be threaded at its ends and assembled together the cylinder head 4, cylinder 3 and the crankcase 2. Alternatively, tie rod 21 may extend through the tube connection 15 from the cylinder head 4 into the crankcase 2.

If the inlet valve 13 is open, cooling air therefore flows directly into the crankcase 2 and leaves the crankcase 2 via the outlet valve 14 when the piston 7 performs a downward movement in the cylinder 3. This causes an excess pressure in the crankcase 2. The roller bearings 10 in the crankcase 2 are cooled directly by the cooling air which flows in, the cooling air being guided into the crankcase 2. In a construction (not shown in greater detail here), two symmetrically arranged tube connections 15, cooling air flows directly onto the two roller bearings 10. In addition, the roller bearing 10' between the crankshaft 8 and the connecting rod 9 is likewise cooled as a result of the contact with the cooling air in the crankcase 2.

The outlet valve 14 is arranged on the bottom side of the crankcase 2, in order to transport any contaminants and water accumulations out of the crankcase 2 and to minimize the loading by contaminants from the outside on account of the bottom-side arrangement. The connection of the tube connection 15 to the crankshaft 2 is diagonally opposed to the outlet valve 14 to create a diagonal cooling air flow in the crankcase. The inlet valve 13 and the outlet valve 14 may be lamellar valves as previously disclosed.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A piston compressor comprising:

a piston in a cylinder;

a connecting rod connecting the piston to a crankshaft in a crankcase by a roller bearing;

an air inlet line and an air outlet line in a cylinder head;

a tube connection between the air inlet line and the crankcase for transporting cooling air from the inlet line to the crankcase, the tube connection being exterior the cylinder and structurally attaching together the crankcase, the cylinder, and the cylinder head;

an inlet valve arranged in the cylinder head and connected to the tube connection, the inlet valve and the tube connection being configured to introduce the cooling air into the crankcase, and wherein the inlet valve opens when the pressure in the crankcase is less than the pressure in the air inlet line; and an outlet valve arranged in a bottom wall of the crankcase, wherein the outlet valve opens when the pressure in the crankcase exceeds a predetermined value, and the outlet valve is configured to transport cooling air, water, and contaminants out of the crankcase.

2. The piston compressor of claim 1, wherein the tube connection is connected to the crankcase at a location in the vicinity of thermally loaded components including the roller bearings which are in the crankcase.

3. The piston compressor of claim 1, wherein the tube connection between the air inlet line and the crankcase includes at least two individually arranged tubes which are connected parallel to one another.

4. The piston compressor of claim 1, wherein the inlet valve and the outlet valve are lamellar valves.

5. The piston compressor of claim 1, wherein the inlet valve is arranged in the cylinder head spaced from a connecting unit which includes the air inlet line and the air outlet line.

6. The piston compressor of claim 1, including at least one tie rod which passes through the tube connection to attach together the crankcase, the cylinder and the cylinder head.

7. The piston compressor of claim 1, wherein between the tube connection and the crankcase and between the tube connection and the cylinder head there is at least one sealing element.

8. The piston compressor of claim 1, wherein the tube connection has cooling bodies on its surface in order to increase the dissipation of heat by convection.

9. The piston compressor of claim 1, wherein the tube connection is connected to the crankcase at a location which is diagonally opposed to the outlet valve connected to the crankcase.

10. The piston compressor of claim 1, wherein the inlet valve is arranged in a valve plate.

* * * * *